US008376259B2

(12) United States Patent
Pienta et al.

(10) Patent No.: US 8,376,259 B2
(45) Date of Patent: Feb. 19, 2013

(54) PROCESS AND APPARATUS FOR LOADING AND UNLOADING AN UNWINDING MACHINE

(75) Inventors: Daniel J. Pienta, Lambertvile, MI (US); David M. Pienta, Lambertville, MI (US)

(73) Assignee: Automatic Handling Intl., Erie, MI (US)

( * ) Notice: Subject to any disclaimer, the term of this patent is extended or adjusted under 35 U.S.C. 154(b) by 0 days.

(21) Appl. No.: 13/134,034

(22) Filed: May 26, 2011

(65) Prior Publication Data

US 2011/0229290 A1 Sep. 22, 2011

Related U.S. Application Data

(62) Division of application No. 12/380,113, filed on Feb. 24, 2009, now Pat. No. 8,016,223.

(51) Int. Cl.
*B65H 19/12* (2006.01)
*B65H 67/02* (2006.01)

(52) U.S. Cl. ..... 242/559

(58) Field of Classification Search ..... 242/558, 242/559, 559.3, 560, 560.1, 561, 533–533.8, 242/596.1, 596.2, 596.3, 611, 612, 613; 414/910, 414/911; 29/895, 895.2, 895.21, 895.33, 29/430

See application file for complete search history.

(56) References Cited

U.S. PATENT DOCUMENTS 5,692,698 A * 12/1997 Forbes ..... 242/533.4

FOREIGN PATENT DOCUMENTS

JP 61277567 A * 12/1986
JP 04327449 A * 11/1992

OTHER PUBLICATIONS

Translation of JP 04327449 A.*
Translation of JP 61277567 A.*

* cited by examiner

*Primary Examiner* — William E Dondero
(74) *Attorney, Agent, or Firm* — Emch, Schaffer, Schaub & Porcello Co., L.P.A.

(57) ABSTRACT

This core plugging station relates generally to preparing rolls of previously wound material for an unwinding machine. The core plugging station improves the automation of moving rolls of sheet form material and the like to be loaded in preparation for unwinding. When a previously loaded roll has been unwound a spent core station disposes of the remaining core. The process sequentially moves rolls of material having cores from a core plugging station to an unwinding station and sequentially moves spent rolls of material from the unwinding station back to a spent core station.

3 Claims, 10 Drawing Sheets

PROCESS AND APPARATUS FOR LOADING AND UNLOADING AN UNWINDING MACHINE

CROSS REFERENCE

This application is a divisional application of and claims the benefit of Ser. No. 12/380,113 filed Feb. 24, 2009 now U.S. Pat. No. 8,106,223.

CROSS REFERENCE TO RELATED APPLICATION

This application claims the benefit of provisional application Ser. No. 61/067,592, filed Feb. 29, 2008.

TECHNICAL FIELD

The present invention relates generally to an apparatus and method for preparing rolls of previously wound material for an unwinding machine. More particularly, the method improves the automation of moving rolls of sheet form material and the like to be loaded in preparation for unwinding and then, when a previously loaded roll has been unwound disposing of the remaining core.

BACKGROUND OF THE INVENTION

Many products are manufactured from elongated sheet or stock material that is shipped and stored in the form of a roll or coil. Continuous strips or webs of thin, flexible material are commonly provided on storage rolls that are subsequently unwound for production of items made from these materials. Examples of these materials are plastic film, metal foil, tissue and paper.

During the manufacture of paper products such as napkins, newspapers, and magazines, for example, very large storage rolls of paper are used to provide the stock material from which the paper items are produced. The storage rolls are unwound for further processing such as cutting, folding or printing. The rolls of raw material may have a length of up to about 300 inches (750 cm) and a weight of up to about 8,000 lbs (3600 kg). Machines such as printing machines or laminating machines to which the sheet is supplied by the unwinding machine usually require the sheet to be supplied at a constant speed and tension. When nearly the entire roll has been unwound from the core, it is necessary for the machine to stop unwinding sheet from the almost empty roll and to commence unwinding sheet from a new roll without any interruption in the supply of sheets to the operating machine. It is thus necessary for the sheet to be cut from the nearly empty roll, and to be secured to the sheet on the new roll to ensure continuous supply of sheet.

Conventionally, the rolls of stock material are prepared for the winding and unwinding machine in a rather labor intensive operation that can sometimes present dangerous working conditions for the operator. The large rolls of material are usually delivered to a work station by conveyor or cart or the like. At the work station, the operator inserts plugs into each end of the roll of stock material. The operator then commonly uses an overhead crane to engage the plugs and lift the roll, of stock material off the conveyor or cart. The operator then prepares the roll for delivery to the unwinding machine. Such preparation usually involves cleaning the surface of the roll and positioning the leading edge of the web of stock material in a certain orientation. Using the overhead crane, the operator then lifts the prepared roll of material and delivers it to the unwinding station. The operator then uses the overhead crane to pick up a spent roll of material and return the spent roll to the work station wherein the operator removes whatever stock material remains on the core, removes the plugs, and delivers the spent core to a spent core storage area. It can be seen that having the operator in such close proximity with the large roll of stock material that sometimes can reach upwards of 8000 pounds presents many challenges for work place safety and efficiency.

Clearly, a need exists for a unique method to quickly change to a new roll once the previous roll is spent.

BRIEF DESCRIPTION OF THE INVENTION

We have developed a unique method to efficiently and safely prepare and transport a new roll of raw material to the apparatus and unwinding station, while also retrieving a spent roll.

The automated process sequentially moves rolls of material having cores from storage to a core plugging station and then to an unwinding station and sequentially moves spent rolls of material from the unwinding station back to a spent core station. The process comprises the steps of sequentially:

(a) feeding unplugged rolls of material having cores to a core plugging station;

(b) automatically aligning at least one core plug with the core of the roll of material in the core plugging station;

(c) automatically inserting the at least one core plug into the core of the roll of material;

(d) feeding the plugged roll of material to an unwinding station;

(e) removing a spent roll of material from the unwinding station;

(f) automatically removing the at least one core plug from the spent roll; and, (g) feeding the spent roll of material to a spent core station.

In a preferred embodiment, the plugging station provides for automatically elevating the roll to allow it to be prepared before sending it to the unwinding station.

In another preferred embodiment, the step of automatically aligning further includes vertically aligning and horizontally aligning the core plug with the core of the roll of material. In another embodiment, the core plug has a central axis, the core of the roll of material has a central axis and the step of automatically aligning further includes aligning the central axis of the core plug with the central axis of the core of the roll of material. The process further includes the step of a spent core gripper receiving the spent roll and transporting it to the spent core station.

Other objects and advantages of the present invention will become apparent to those skilled in the art upon a review of the following detailed description of the preferred embodiments and the accompanying drawings.

DETAILED DESCRIPTION OF THE INVENTION

Figure 1:
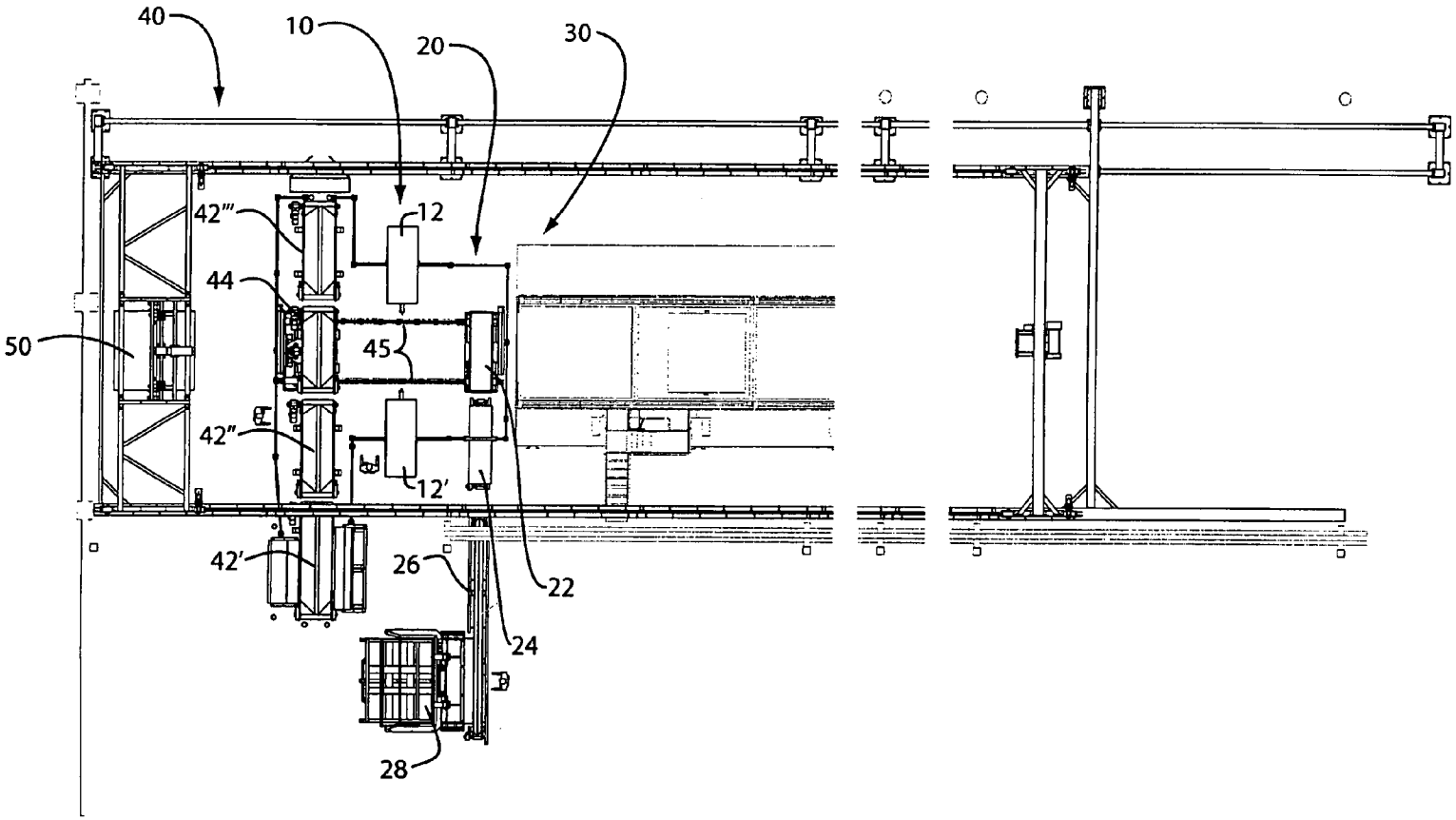
FIG. 1 is a top view of the apparatus of the present invention adjacent an unwinding machine.

The apparatus of this invention sequentially receives rolls of raw material wound about hollow cores and automatically moves the rolls to a core plugging station. The rolls are plugged and prepared for use. The rolls are then moved to an unwinding machine. The apparatus and method of the invention then automatically and sequentially moves spent rolls of material from the unwinding machine back to a spent core station. The apparatus comprises:

(a) a core plugging station;

(b) a roll conveyor station for feeding unplugged rolls of raw material having hollow cores to the core plugging station;

(c) a means for automatically aligning at least one core plug with the core of a roll of material in the core plugging station;

(d) a means for automatically inserting the at least one core plug into the core of the roll of material;

(e) a means for transferring the plugged roll of material to an unwinding station;

(f) a means for removing a spent roll of material from the unwinding station;

(g) a spent core station;

(h) a means for removing the at least one core plug from the spent roll; and (i) a means for feeding the spent roll of material to the spent core station.

The roll of raw material is transferred from an inventory stock of rolls via conveyor until it is positioned on the roll cart conveyor. The roll cart conveyor is positioned on rails that extend between the conveyor station and the core plugging station. The roll cart conveyor automatically transports the roll of raw material to the core plugging station. The roll cart conveyor further includes a turntable assembly for angularly positioning the roll of raw material within the core plugging station.

In the preferred embodiment, the core plugging station includes the means for automatically aligning the at least one core plug, the means for automatically inserting the at least one core plug, and the means for removing the at least one core plug. The means for automatically aligning the at least one core plug further includes a lifting frame designed to vertically align the central axis of the core plug with the central axis of the hollow core and a roll cart conveyor for horizontally aligning the central axis of the core plug with the central area of the hollow core. Once the central axes are aligned, both vertically and horizontally, the core can be rotated by a turntable assembly to angular align the center lines. Upon complete vertical, horizontal and angular alignment, the core plugs are inserted into the hollow core at each end of the roll of raw material. In the preferred embodiment, there are two core plugs, one on each end. The core plugs are retained in the core plugging station by friction fit.

Once the core plugs are inserted into the hollow core of the roll of raw material, the lifting frame lifts the roll of raw material vertically so that it no longer engages with the roll cart conveyor. The lifting frame then supports the roll of raw material while the roll is prepared by a worker for placement in the unwinding machine. Once the roll is prepared an overhead crane lowers carry hooks to engage the plug inserts, the core plug probes are withdrawn from the core inserts and the overhead crane lifts and carries the roll of raw material into position on the unwinding machine.

In the preferred embodiment, the roll of raw material replaces a spent roll of raw material. On the return trip, the overhead crane retrieves the spent roll of raw material and transfers the spent roll to the spent core cart. The spent core cart will transfer on tracks between the spent core station and the plugging station. At the plugging station, the core plug probes are inserted into the core plugs and the plugs are removed from the spent core. The spent core cart returns to the spent core station where the worker cleans and prepares the core for reuse. Once the core is prepared and cleaned for reuse, a conveyor transports the spent core to a spent core storage bin.

Figure 2:
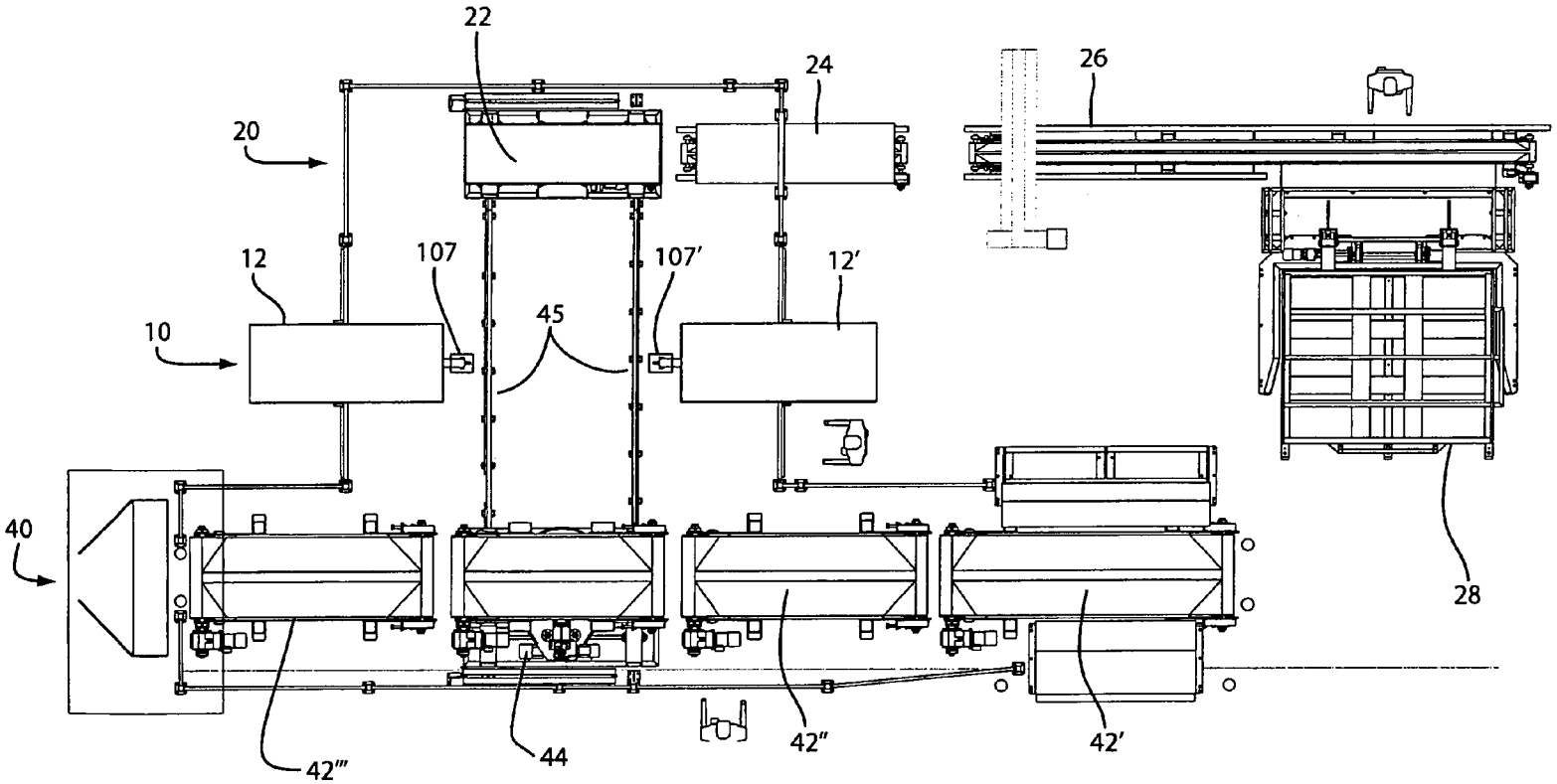
FIG. 2 is an enlarged, top view showing the apparatus of the present invention in greater detail.

Referring now to FIGS. 1 and 2 the apparatus for loading and unloading an unwinding machine is shown in greater detail. The apparatus includes a core plugging station 10, a spent core station 20 adjacent an unwinding machine 30, and a roll conveyor station 40. The roll conveyor station 40 includes a plurality of feed belt conveyors 42', 42" and a roll cart conveyor 44. Rolls of raw material (not shown) are positioned on conveyor 42' and fed by conveyor 42" to roll cart conveyor 44. If for some reason the roll of raw material is not properly oriented or is sequentially out of step with the required automated process of the unwinding machine, a parking station conveyor 42''' is available. Such out of sequence roll can be moved from the roll cart conveyor 44 to the parking station 42''' and held until it is sequentially matched to move to the unwind machine. At which time conveyor 42''' moves the parked roll of raw material back to the roll cart conveyor 44.

The roll cart conveyor 44 is positioned on parallel tracks 45 for movement between the conveyor station 40 and the core plugging station 10. In operation, once the roll cart conveyor 44 receives a roll of raw material, it automatically drives itself to a position in the core plugging station 10 proximate the core plugging machines 12, 12'. As will be discussed in detail later, the roll cart conveyor 44 positions the roll of raw material at a proper angular relationship with respect to the core plugging machines 12, 12'. The core plugging machines and roll cart conveyor 44 then move vertically and horizontally to visually align the center line of the core of the roll of raw material with the center line of the core plug members 111, 111'. Once the roll of raw material receives the core plug members 111, 111' the core plugging machines 12, 12' elevate the roll of raw material off of the roll cart conveyor 44. The roll cart conveyor 44 then travels back to the conveyor station 40 to receive another roll of raw material.

Once the roll of raw material at the plugging station 10 is prepared for transport to the unwind machine, the overhead crane 50 (FIG. 1) travels to the plugging station 10 and retrieves the roll of raw material for transport to the unwind machine.

Upon return from the unwind machine, the overhead crane 50 will retrieve a spent roll of material and return the spent roll of material to the spent core station 20. As will be discussed in detail with respect to further figures, the spent core station 20 has a spent core cart 122 with a gripper assembly.

The spent core cart 122 travels on rails between the spent core station 20 and the plugging station 10, where the core plugs are removed from the spent core. The spent core cart 22 then returns to the spent core station 20 where the worker cleans remaining raw material from the core. Once the core is cleaned, the spent core conveyor 24, 26 transfers the spent core to the spent core lift 28 for depositing in spent core storage (not shown).

Figure 3:
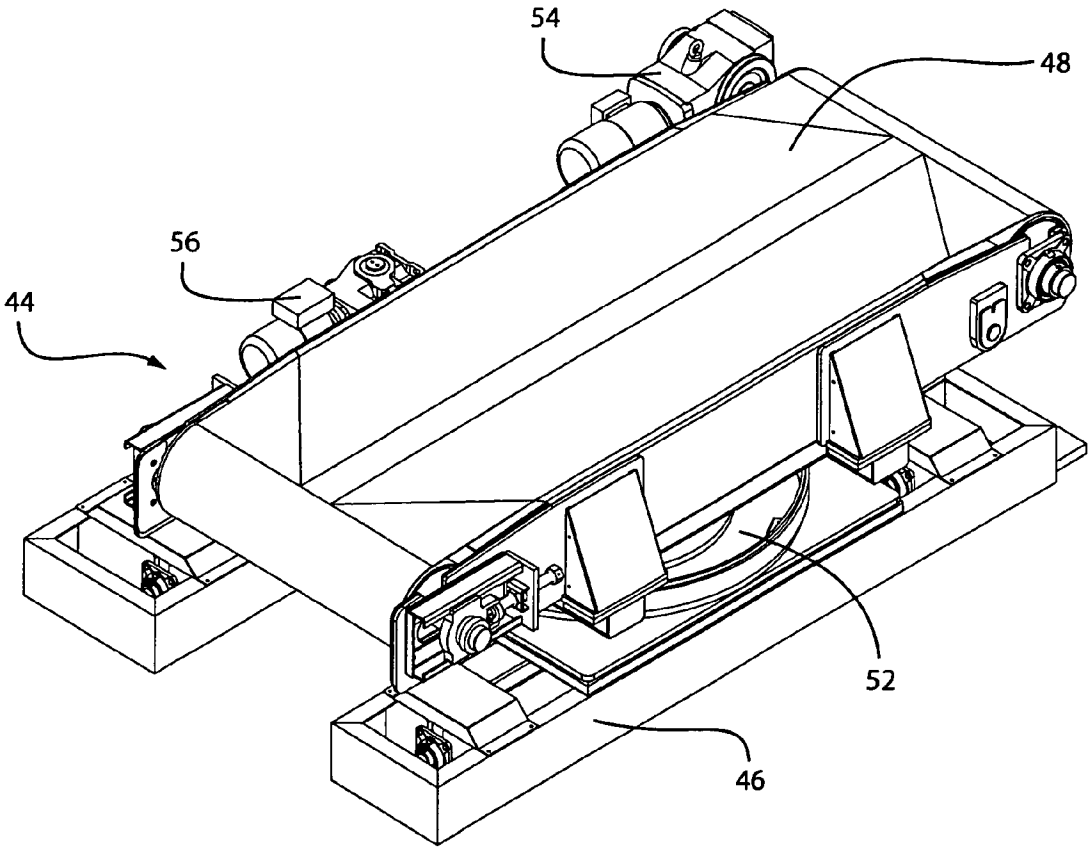
FIG. 3 is a perspective view showing a roll cart conveyor with a turntable assembly.
Figure 4:
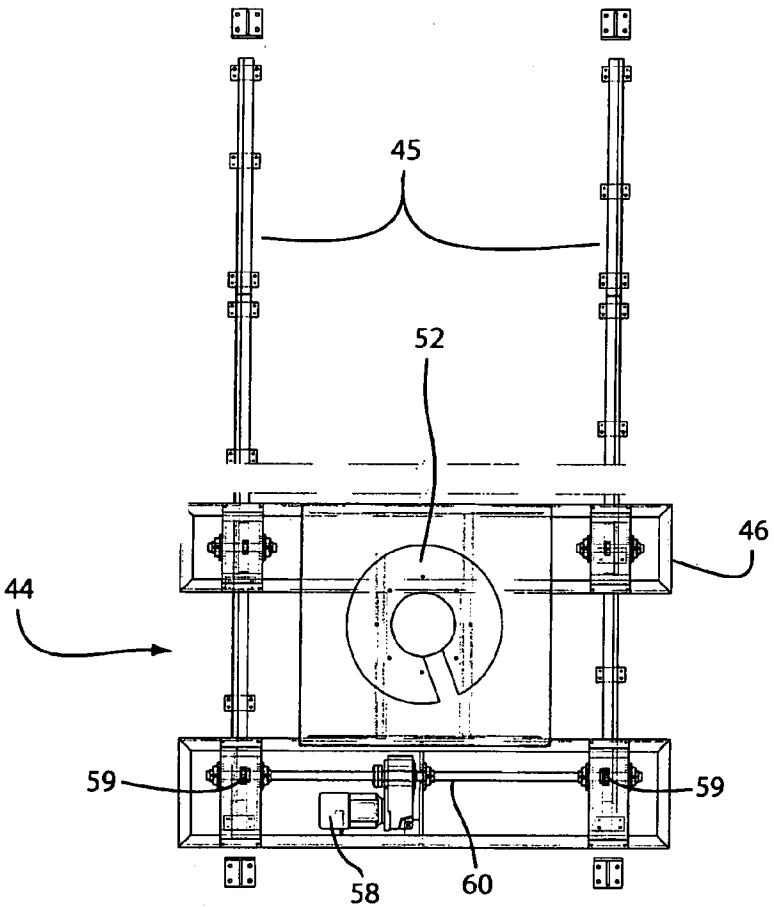
FIG. 4 is a top view of the roll cart with conveyor removed to show the turntable in greater detail.
Figure 5B:
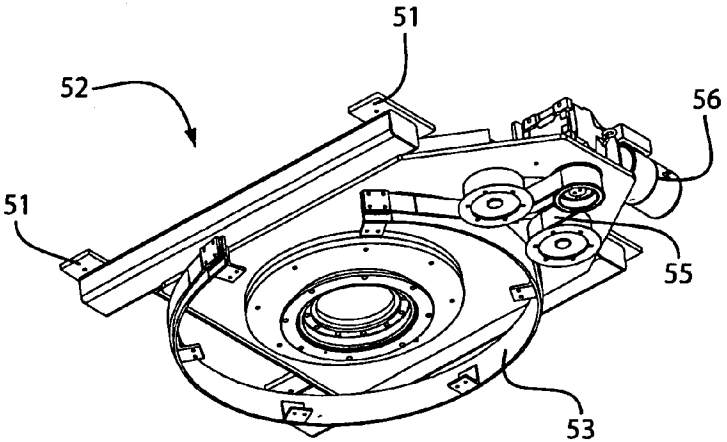
FIGS. 5A and 5B are perspective views showing the turntable of the roll cart in greater detail.
Figure 5A:
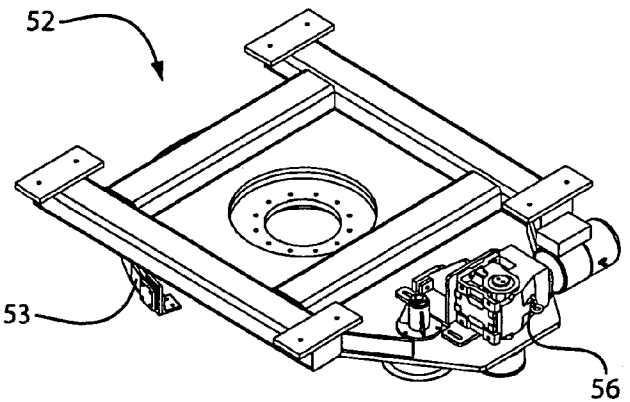

Referring now to the remaining figures, the various components of the conveyor station 40, plugging station 10, and spent core station 20 will be discussed in greater detail. Referring now to FIGS. 3, 4 and 5, the roll cart conveyor 44 is shown in greater detail. The roll cart conveyor 44 includes a roll cart 46 which is positioned on tracks 45 (FIG. 4). Referring now to FIG. 4, servo motor 58 is linked to drive wheels 59 by axle 60 for driving the roll cart 46 along the tracks 45. Mounted on the roll cart 46 is turntable 52 and the roll cart conveyor 48 is engaged with the turntable 52. Referring now to FIGS. 5 and 5A, the turntable 52 is shown in greater detail. The turntable 52 includes brackets 51 for engaging with the roller conveyor 48 and circular drive bracket 53 for engaging with the roll cart 46. Servo drive motor 56 is engaged with the circular drive bracket 53 by drive belt 55. As the servo motor 56 drives the drive belt 55 it causes the turntable 52 to rotate about the circular drive bracket 53. Preferably, a laser aligning device (not shown) feeds signals to the servo motor 56 to assist in properly aligning the roll of raw material within the plugging station. Conveyor drive 54 is used to drive conveyor belt 48.

Figures 6, 6A:
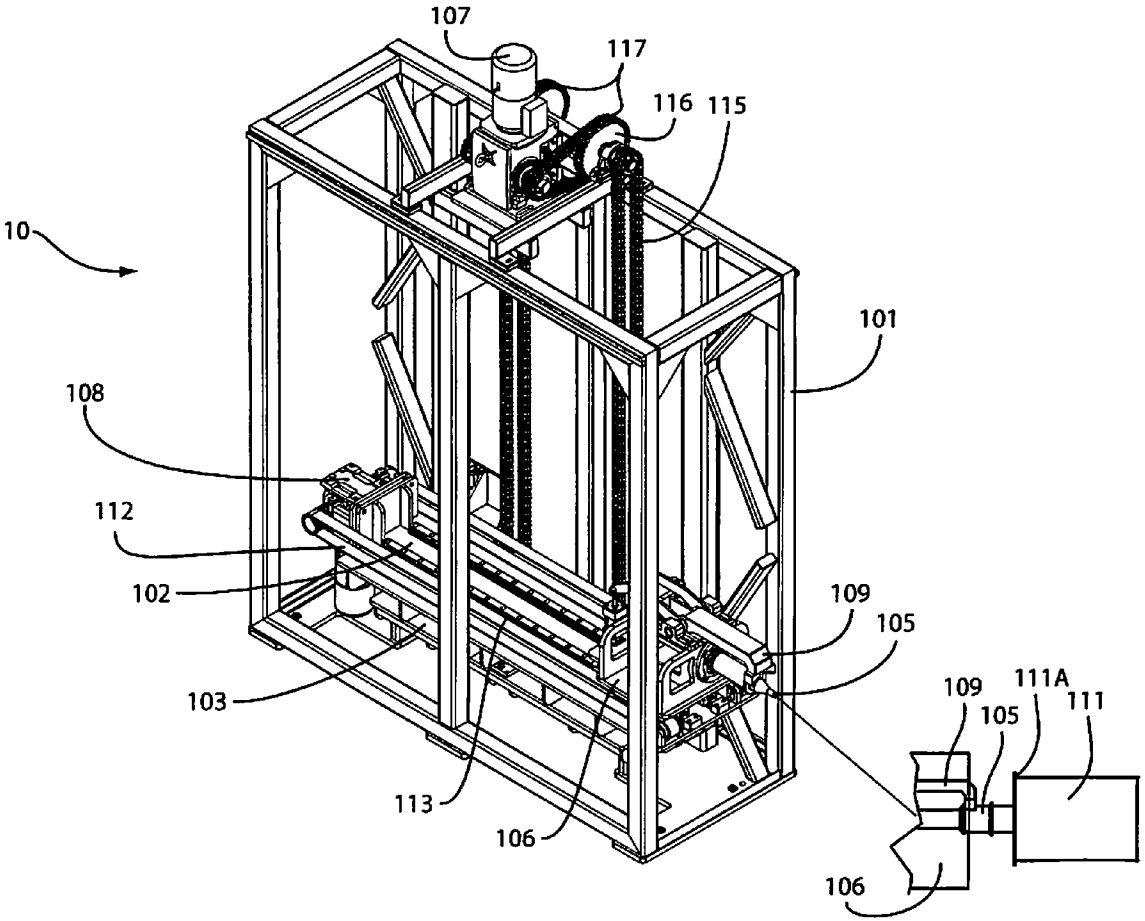
FIG. 6 is a perspective view showing a core plugging station.
FIG. 6A is a detail view of a core plug positioned on a core plug probe.
Figure 7:
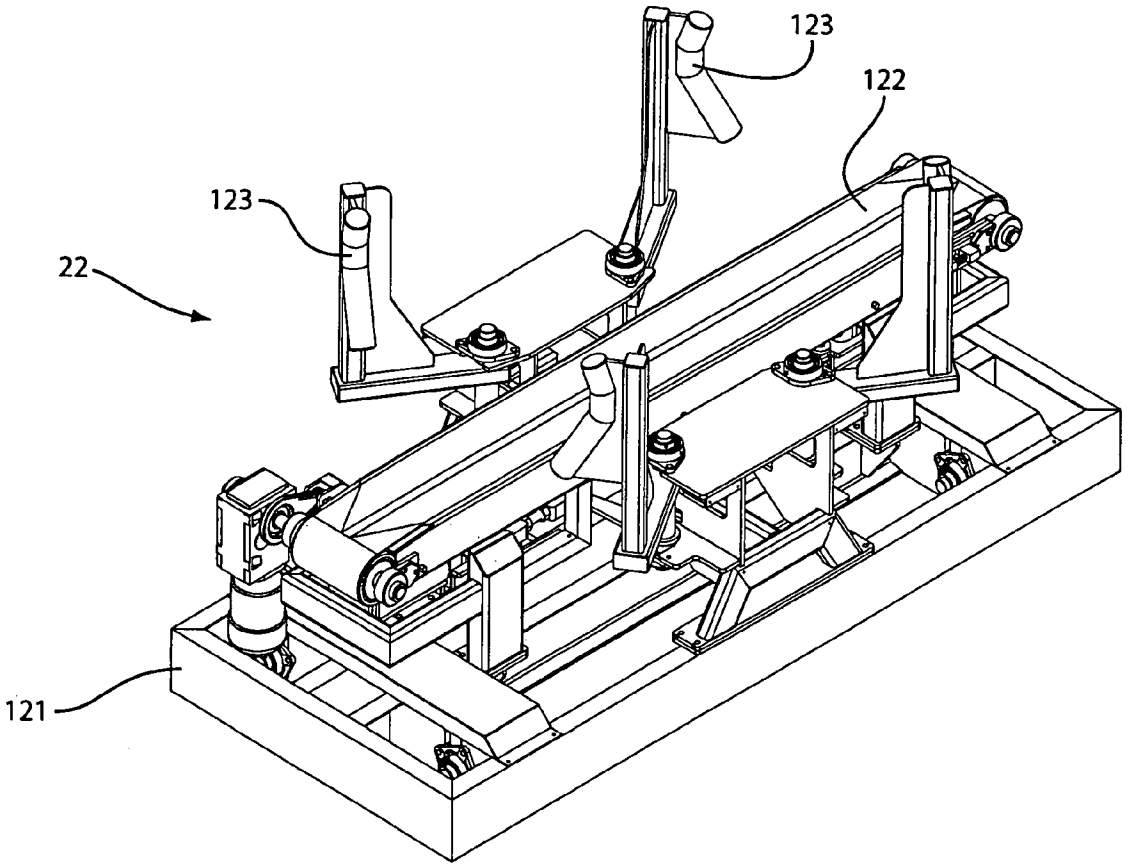
FIG. 7 is a perspective view of a spent core cart with a core gripper assembly.

Referring now to FIG. 6, the plugging station will be described in further detail. Each core plugging machine includes a base frame 101 and a lifting frame 103 positioned within the base frame 101 and a pulling frame 102 positioned on the lifting frame 103. The lifting frame 103 moves vertically within the base frame 101. Drive motor 107 is positioned on top of the base frame 101 and is engaged with the lifting frame 103 by means of drive chains 117 engaged with drive pulleys 116 which in turn are engaged with lifting chains 115. The pulling frame 102 includes a drive motor 108, a pair of guide rails 113 and a pulling head 106 positioned for movement on the guide rails 113. The drive motor 108 is engaged with the pulling head 106 by drive belt 112. The pulling head 106 carries the core plug probe 105 and core plug clamp 109. Referring now to FIG. 6A, the core plug probe 105 carries the core plug 111 and the core plug clamp 109 engages a lip 111*a* of the core plug member 111 to hold the core plug member 111 on the core plug probe 105. After the core plug member 111 is inserted into the roll of raw material, the core plug clamp 109 disengages from the lip 111*a* of the core plug member 111 and the pulling head 106 retracts thus disengaging the core plug 111 from the core plug probe 105. Sensors (not shown), preferably lasers, are located on the pulling head 106 to assist in aligning the center line of the core plug probe 105 and core plug 111 with the center line of the roll of raw material.

In operation, the roll cart conveyor 44 positions the roll of raw material proximate the core plugging station 10 and the sensors on the pulling head 106 align the center line of the core plug probe 105 and core plug 111 with the center line of the core of the roll of raw material. Alignment is effected by vertical movement of the lifting frame 103 and horizontal movement of the roll cart conveyor 44 on the rails. Angular alignment is achieved by the turntable 52 on the roll cart conveyor 44. Once the proper alignment of the center lines of the core of the roll of raw material and the plug member 111 are aligned, drive motor 108 is activated to move the pulling head forward toward the roll of raw material thus engaging the core plug 111 within the core. Drive motor 107 is then activated to elevate the lifting frame 103, thus lifting the roll of raw material off the surface of the roll cart conveyor 44. The roll of raw material is then prepared for transfer to the unwind machine by the worker. After the roll of raw material is prepared, the overhead crane 50 arrives to engage the plug members 111. Clamping member 109 disengages from the lip 111*a* of the plug member 111 and the roll of raw material can then be transported to the unwind machine.

Figure 8:
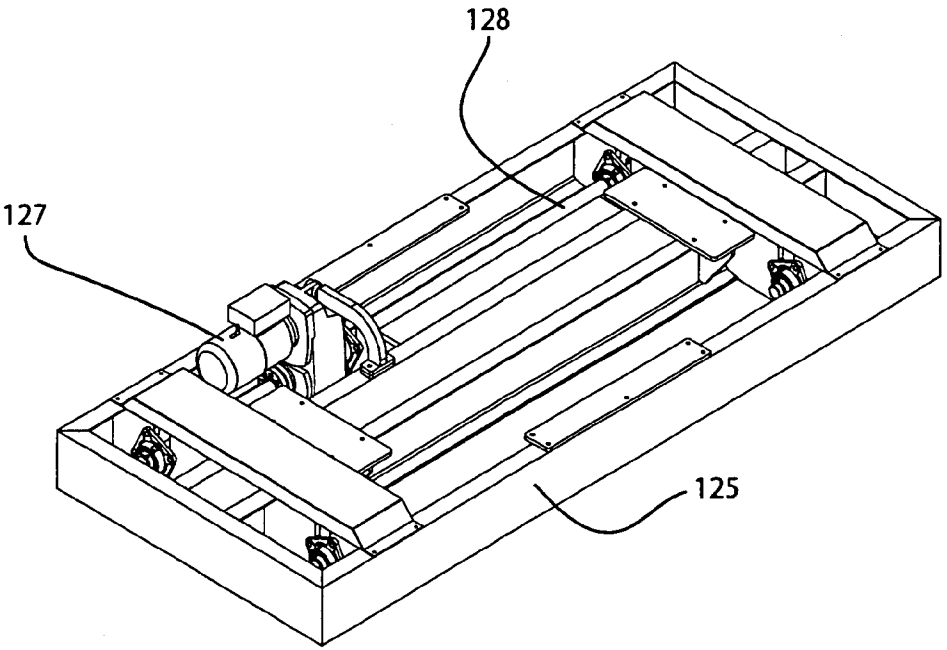
FIG. 8 is a perspective view of the undercarriage of the spent core cart.

Referring now to FIGS. 7-10, the spent core cart 22 having a core gripper assembly 123 will be described in detail. The spent core cart 22 consists of three main components: the core gripper assembly 123, conveyor 122 and cart frame 125. Referring to FIG. 8, the cart frame 122 includes wheels (not shown) for engagement with the rails 45 such that the spent core cart 22 can move between the spent core station 20 and the plugging station 10. Drive motor 127 is engaged with the wheels by means of drive shaft 128.

Figure 10:
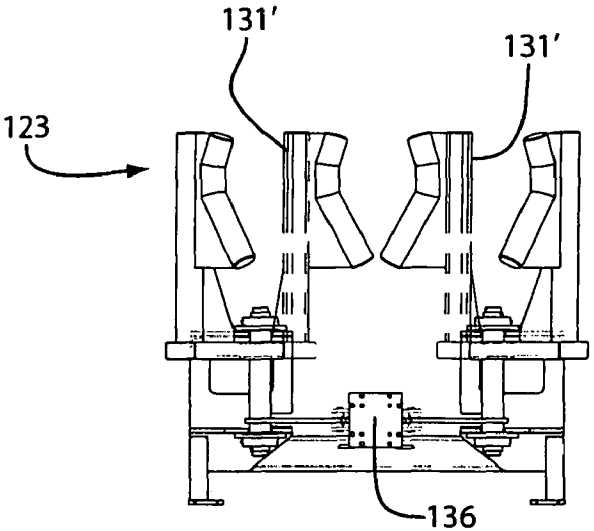
FIG. 10 is a side view of the core gripper showing the closed position in phantom.
Figure 9:
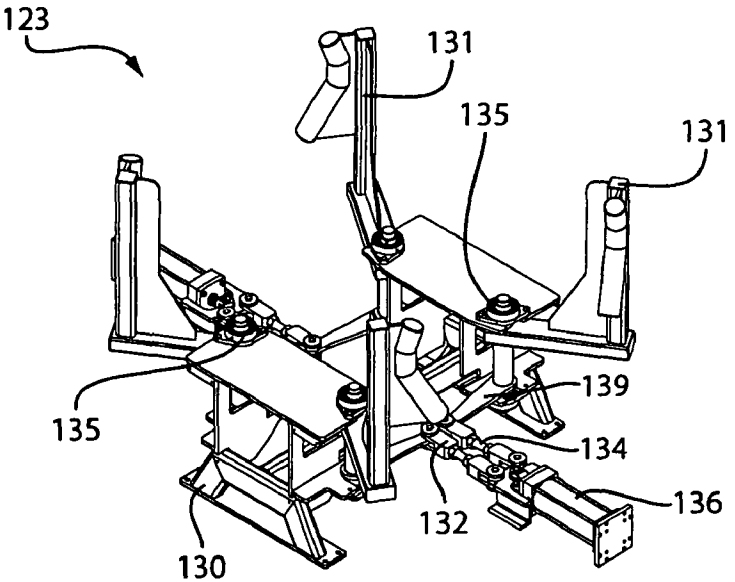
FIG. 9 is a perspective view showing the core gripper assembly.

Referring now to FIGS. 9 and 10, the spent core gripper 123 is mounted on the frame 125 by base frame 130. Gripper arms 131 are mounted for rotation on the base frame 130 in bearings 135. The gripper arms 131 are movable into position to engage with a spent core of any given diameter through the adjustable linkage comprising pivot arms 139 engaged with a pair of pneumatic cylinders 136 through clevis 132 and adjustment rod 134. FIG. 10 shows a side view of the core gripper 123 with the gripper arms 131 in an open disengaged position and, in ghost, the gripper arms in a closed engaged position 131' with a spent core.

Figure 12:
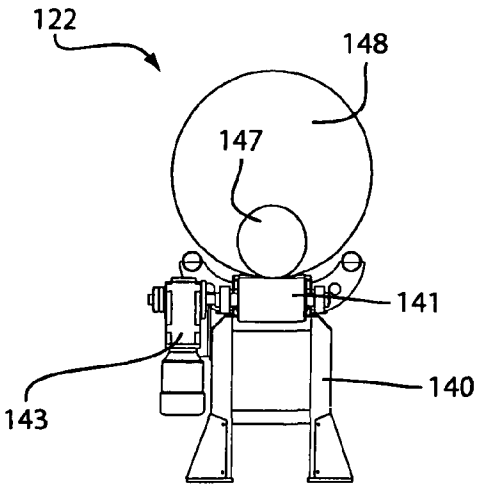
FIG. 12 is a side view of the spent core conveyor showing minimum size spent core and a maximum size spent core in phantom.
Figure 11:
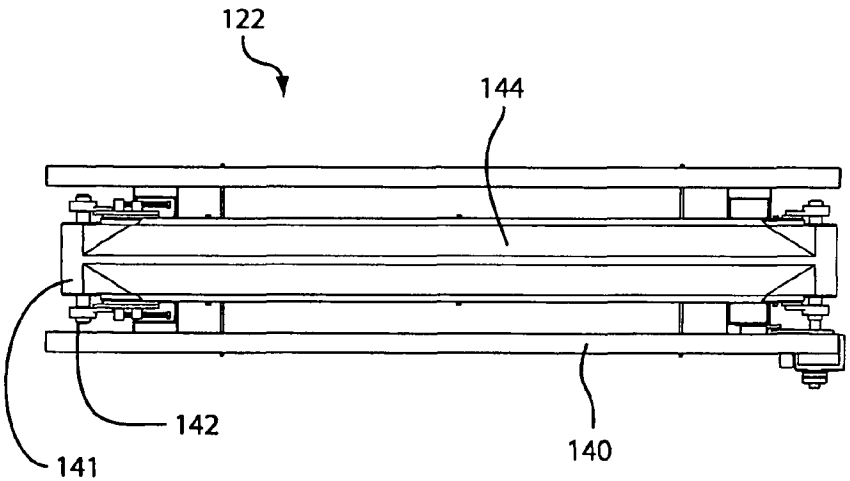
FIG. 11 is a top view of a spent core conveyor.

Referring now to FIGS. 11 and 12, the spent core conveyor 22 includes a frame 140, drive rollers 141, motor 143 and belting 144. If desired, conventional non-drive rollers (not shown) may be located beneath the belting 144 to support the belt under the weight of the spent core. FIG. 12 is a side view of the spent core conveyor 122 showing a minimum circumference spent core 147 and a maximum circumference spent core 148 in phantom. When a roll is being unwound so that the material can be further processed, it is desirable to quickly change to a new roll once the previous roll is spent. The time spent loading, unloading and reloading the machine results in decreased production of the final product. As can be seen in phantom, spent cores 147 and 148, the size of the spent core varies widely. The apparatus of the spent core conveyor 122 and the spent core gripper have been designed to handle these wide variations.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A core handling station for automatically and sequentially preparing rolls of tissue wound on cores, such cores defining an interior having a central axis, for transfer to an unwinding station and for sequentially receiving spent cores of tissue from the unwinding station and preparing the spent cores of tissue for transfer to a spent core station comprising, in combination:

a core processing station having a lifting frame engaged with a pulling frame and a lifting drive member for providing vertical motion to the pulling frame, the pulling frame including a pair of opposed clamp members defining a horizontal center line, a pulling drive member for providing horizontal the clamp members engaing and disengaging being aligned on the horizontal center line, and a sensor for providing signals to assist in aligning the roll of tissue with the horizontal centerline;

a roll cart for receiving the roll of tissue, the roll cart including a turntable and a drive member, wherein the drive member acts to move the roll cart and roll of tissue into proximity with the core processing station, whereby the sensor member provides signals to the drive member to horizontally align the central axis of the roll of tissue with the horizontal center line and provides signals to the turn table to rotate the roll of tissue to angularly align the central axis of the roll of tissue with the horizontal center line and provide signals to the lifting frame to raise or lower the pulling frame to vertically align the horizontal center line with the central axis of the roll of tissue, whereby upon complete alignment of the central axis of the roll of tissue with the horizontal center line, the clamp members carrying the core plugs are horizontally moved to engage the core plugs with the interior of the core, whereby the clamp is opened to release the core plugs and return to a disengaged position leaving the core plugs engaged with the interior of the core.

2. The core handling station of claim 1 further including a spent roll cart having a drive member for moving the roll cart into and out of proximity with the core processing station and a gripper member wherein, upon the delivery of a spent roll of tissue having core plugs inserted therein, the gripper member engages the spent roll to fix it in place on the spent roll cart and the drive member moves the spent roll cart into proximity with the core processing station, whereby the sensor member of the core processing station provides signals to the lifting frame to move the clamp members into vertical alignment with the core plugs and provide signals to the drive member for the spent roll cart to move the core plugs into horizontal alignment with the clamp members, whereby upon achieving alignment, the pulling drive member moves the clamp members horizontally into engagement with the core plugs, the clamp members close around the core plugs and the drive member moves the clamp members away from the spent roll of tissue thereby disengaging the core plugs from the spent roll of tissue.

3. The core processing station of claim 2 further including an infeed conveyor for supplying rolls of tissue to the roll cart and an outfeed conveyor for removing the spent roll of tissue from the spent roll cart.

* * * * *

UNITED STATES PATENT AND TRADEMARK OFFICE

CERTIFICATE OF CORRECTION

PATENT NO. : 8,376,259 B2
APPLICATION NO. : 13/134034
DATED : February 19, 2013
INVENTOR(S) : Daniel J. Pienta et al.

It is certified that error appears in the above-identified patent and that said Letters Patent is hereby corrected as shown below:

In the Specifications:

Column 7, line 2, please insert -- motion to -- after the word horizontal.

Column 7, line 2, please insert -- , and the clamp members -- after the words clamp members.

Column 7, line 3, please insert -- core plugs of various sizes, the core plugs -- after the word disengaging.

Signed and Sealed this
Fourteenth Day of May, 2013

Teresa Stanek Rea
*Acting Director of the United States Patent and Trademark Office*